US006963283B1

(12) United States Patent
Gonzalez

(10) Patent No.: US 6,963,283 B1
(45) Date of Patent: Nov. 8, 2005

(54) CHILD ALERT SYSTEM

(76) Inventor: Thomas A. Gonzalez, 6138 N. Maclay St., San Bernardino, CA (US) 92407

( * ) Notice: Subject to any disclaimer, the term of this patent is extended or adjusted under 35 U.S.C. 154(b) by 0 days.

(21) Appl. No.: 09/784,654

(22) Filed: Feb. 15, 2001

Related U.S. Application Data

(60) Provisional application No. 60/182,592, filed on Feb. 15, 2000.

(51) Int. Cl.[7] ..... G08B 23/00
(52) U.S. Cl. ..... 340/573.1; 340/573.4; 340/539.1; 340/574; 340/693; 340/568; 340/531
(58) Field of Search ..... 340/573.1, 573.4, 340/539, 574, 693, 568, 531

(56) References Cited

U.S. PATENT DOCUMENTS 4,876,710 A * 10/1989 Reed et al. ..... 455/404.1
5,650,770 A * 7/1997 Schlager et al. ..... 340/573
5,661,460 A * 8/1997 Sallen et al. ..... 340/573
5,689,240 A * 11/1997 Traxler ..... 340/573
5,731,757 A * 3/1998 Layson, Jr. ..... 340/573
5,828,306 A * 10/1998 Curran ..... 340/573
5,841,352 A * 11/1998 Prakash ..... 340/573
5,936,530 A * 8/1999 Meinhold ..... 340/573.1
5,982,808 A * 11/1999 Otto ..... 375/139
6,072,396 A * 6/2000 Gaukel ..... 340/573.4
6,127,931 A * 10/2000 Mohr ..... 340/573.4
6,243,039 B1 * 6/2001 Elliot ..... 342/457
6,362,778 B2 * 3/2002 Neher ..... 342/357.07

* cited by examiner

*Primary Examiner*—Tai T. Nguyen
(74) *Attorney, Agent, or Firm*—Buhler & Associates; Kirk A. Buhler

(57) ABSTRACT

A child alert system that uses radio transmitters and receivers to provide the location of a child, adult or object to which a transmitter unit of the system is attached. The transmitter unit includes a panic button for allowing the wearer of the transmitter unit to send a panic signal when they feel endangered.

1 Claim, 3 Drawing Sheets

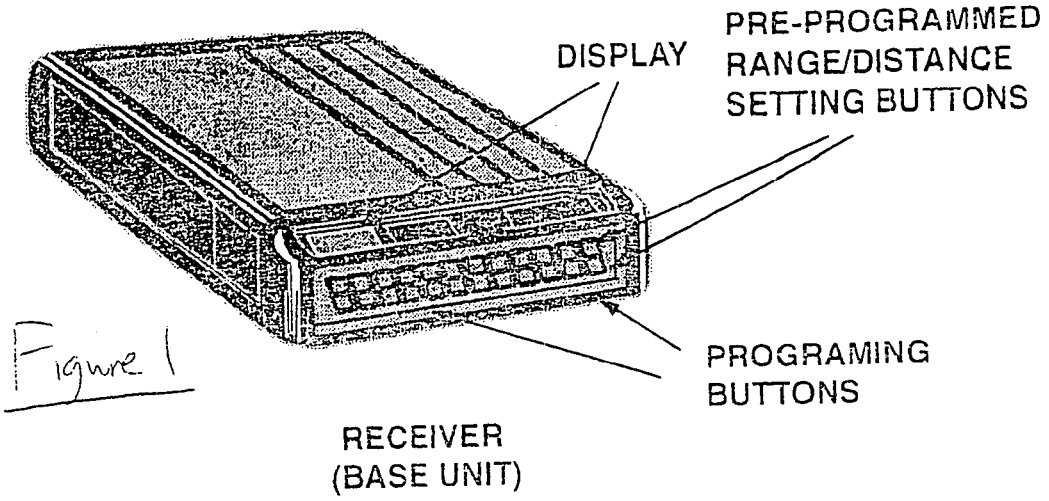
Figure 1
Figure 2
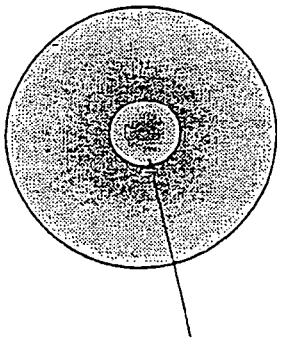
TRANSMITTER
( ROUND PIN STYLE)
PANIC BUTTON

CHILD ALERT SYSTEM

This application claims the benefit of Provisional application Ser. No. 60/182,592, filed Feb. 15, 2000.

TECHNICAL FIELD

The present invention is that of an electronic transmitting device that would allow authorities to locate a missing child or adult.

BACKGROUND ART

The present invention would be an electronic transmitting device that would be remotely activated by authorities to locate a missing child or adult, or instead could be activated by the wearer to send out an emergency signal when in danger by using satellite triangulation.

GENERAL SUMMARY DISCUSSION OF INVENTION

The present invention would comprise a receiver unit and a transmitter unit.

The transmitter unit of the present invention would feature a small battery powered transmitter that would be worn as a watch, bracelet, or pinned to the clothing of a child and would be activated either remotely or by a user, to allow their location to be quickly determined. The transmitter would have a panic button allowing a wearer to send out an emergency signal if they so desired. The panic button would have to be pushed twice, which would prevent accidental activation, in order to send out a signal that would be picked up by the receiver unit of the present invention to alert the receiver unit that the wearer of the transmitter unit requires aid or assistance.

The receiver unit of the present invention would be maintained by local authorities, and would have the frequency or frequencies of all transmitters in the local area loaded into the receiver unit's software. By doing this, this would alert the authorities to activate the applicable user-worn transmitter in the event that a specific person is reported missing. It would also allow the authorities to identify the user when an emergency signal is sent out by the wearer of the device.

The present invention could also have a receiver that would be as small as the size of a pager. The pager would have an adjustable range setting which would be set off if the child, person, or other object that would be carrying the transmitter would be further away in distance than the preset distance on the receiver. The receiver, in this instance, would be carried by a parent or guardian.

Use of the present invention would provide a method of quickly locating a lost, injured, or abducted child or adult, and would also allow that person to send out an emergency signal if they were in danger, so that authorities could quickly come to their aid. The present invention could also be utilized with a pet.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the receiver unit.

FIG. 2 is a top plan view of a round pin style transmitter.

EXEMPLARY MODE FOR CARRYING OUT THE INVENTION

Figure 3:
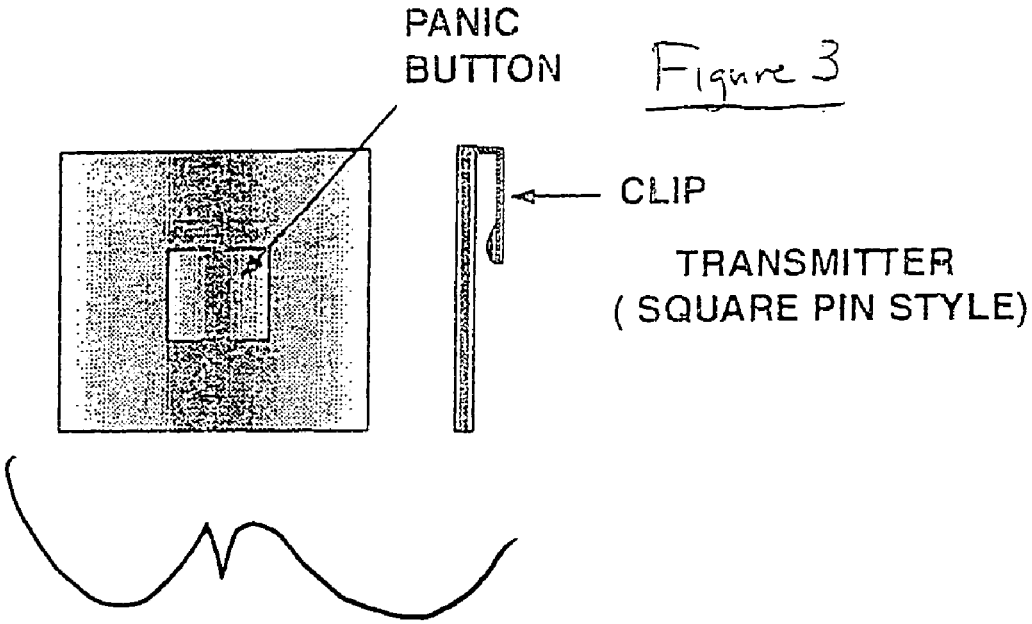
FIG. 3 is two plan views of a square pin style transmitter.
Figure 4:
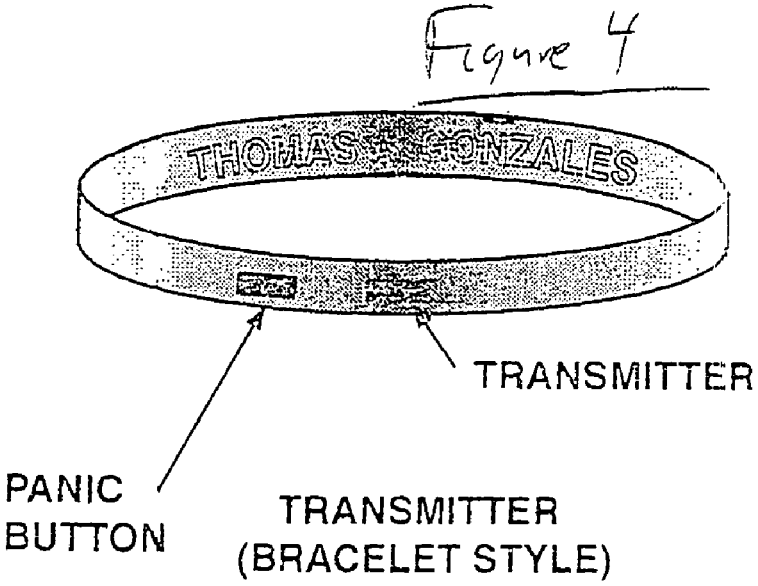
FIG. 4 is a perspective view of a bracelet style transmitter.
Figure 5:
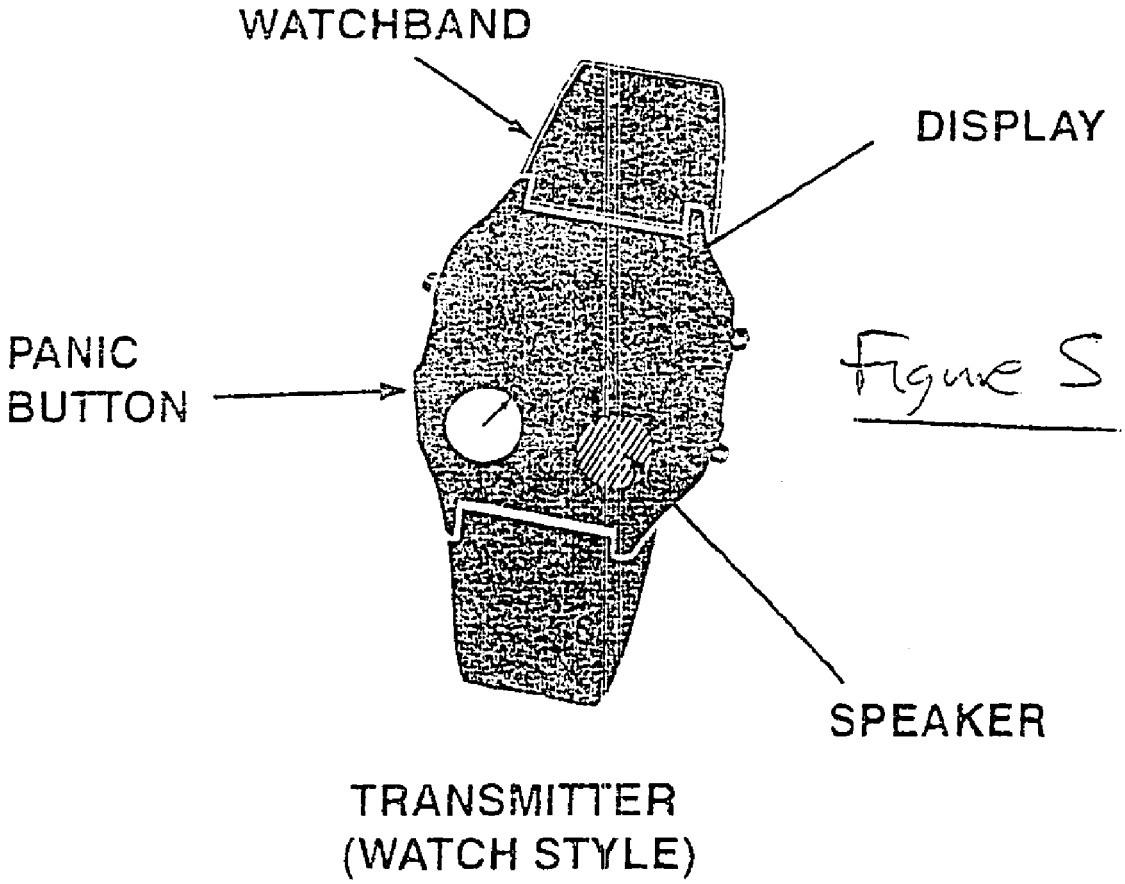
FIG. 5 is a plan view of a wrist watch style transmitter.

A receiver unit of the present invention can be seen in a perspective view in FIG. 1. A transmitter, round pin style, can be seen in a front view in FIG. 2. A transmitter, square pin style, can be seen in a front and side view in FIG. 3. A transmitter, bracelet style, can be seen in a perspective view in FIG. 4. A transmitter, incorporated into a watch, can be seen in a front view in FIG. 5.

If the receiver were the size of a small pager, the receiver would have three range settings which could be adjusted by a parent or guardian to determine how far a child, adult, pet, or other object would be away from a house or other location. For instance, if the parent or guardian would set the range for 500 feet and the child, person, or other object passes that range, the receiver/pager would beep loud and the child's ID number would flash on the screen, or if the child or person carrying the device hit the panic button, the same reaction on the receiver/pager would be registered.

In use, a user would simply attach a transmitter of the present invention to a child or to an adult, in the desired configuration, such as a watch, bracelet, or pin, and enjoy the knowledge that the exact location of the child or adult could be quickly determined if they are missing or suspected of being a party to foul play. In the event that such a situation would arise, a parent would contact the local authorities, who with the previous recorded transmitter frequency, would activate the transmitter and cause it to send a signal to an overhead satellite network. Satellites would triangulate the received signal, and provide the authorities with the exact location of the signal source, allowing them to quickly go to the child or adult's aid. The panic button feature of the transmitter would allow a wearer to activate the signal if in danger or distress, alerting authorities of their identity and location, again allowing them to contact the parents and respond to the wearer's aid.

Use of the present invention would provide a very practical and easy to use method of allowing authorities to almost immediately determine the location of a child who may be missing or abducted, and would also allow a child or adult to send out a signal for help if in danger or distressed, so that aid would quickly be on the way.

What is claimed is:

1. A child alert system comprising:

a receiver unit; and a transmitter unit;

the transmitter unit including a battery powered transmitter and a transmitter unit receiver installed within a jewelry item to be worn by a user that is activated remotely by an activation radio signal received by the transmitter unit receiver and locally by depressing a panic button twice in rapid sequence for allowing a wearer to send out an emergency signal if they so desire;

the receiver unit including receiver unit software programmed with the transmitting frequency of the transmitter unit and a receiver unit transmitter for transmitting the activation radio signal;

when activated, the transmitter unit transmitting a signal an overhead satellite network which responds by triangulating on the received signal and which then transmits a coordinate signal to the receiver unit to instantly provide an operator of the receiver unit with the location of an individual wearing the transmitter unit.

* * * * *